US006776808B2

(12) United States Patent
Foster

(10) Patent No.: US 6,776,808 B2
(45) Date of Patent: Aug. 17, 2004

(54) ADDITIVE TO PREVENT OIL SEPARATION IN PARAFFIN WAXES

(75) Inventor: Rodney Jay Foster, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 35 days.

(21) Appl. No.: 10/230,829

(22) Filed: Aug. 29, 2002

(65) Prior Publication Data

US 2004/0040200 A1 Mar. 4, 2004

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS 4,239,546 A * 12/1980 Russell et al. ..... 106/270

OTHER PUBLICATIONS

N. Marsden, et al., "Paraffin Mottling in Candlemaking," Product Brochure, The International Group, Inc., Sep., 1999, pp. 1–5.

* cited by examiner

*Primary Examiner*—Cephia D. Toomer
(74) *Attorney, Agent, or Firm*—Madan, Mossman, Sriram P.C.

(57) ABSTRACT

The discovery that branched poly(alpha olefin) additives inhibit the separation of liquid oil additives from paraffin wax in paraffin objects such as candles is described. The branched poly(alpha olefin) additives help solve the problem of liquid oil additives such as fragrances and dyes separating or pooling in the top surfaces of candles after storage at room temperature while retaining a mottled appearance of the candle.

22 Claims, No Drawings

ADDITIVE TO PREVENT OIL SEPARATION IN PARAFFIN WAXES

FIELD OF THE INVENTION

The invention relates to methods and additives for improving the stability and appearance of paraffin candles, and most particularly relates, in one non-limiting embodiment, to methods and additives for inhibiting the separation of oils from paraffin candles.

BACKGROUND OF THE INVENTION

Modern candles are primarily made of paraffin waxes obtained as a by-product of petroleum refining operations. Paraffin waxes are generally white, translucent, tasteless, odorless solids consisting of a mixture of solid hydrocarbons of relatively high molecular weight. Stearin is often added to the paraffin wax to create stronger candles and stearic acid is a candle additive used to harden and opacify wax. VYBAR 103® Polymer and VYBAR® 260 Polymer are two common additives in modern paraffin modification used for but not limited to the following purposes, stabilizing oil in paraffin, increasing opacity, and increasing hardness. VYBAR 103® Polymer is a poly (alpha olefin) additive with a molecular weight (Mn) of about 4400 available from Baker Petrolite. VYBAR 260® Polymer is a poly (alpha olefin) additive with a molecular weight (Mn) of about 2600 available from Baker Petrolite.

Because paraffin wax is odorless, fragrances or essential oils are often added to provide a scent or pleasing aroma during burning, and because paraffin waxes are colorless, they are often colored using liquid dyes. Powdered dyes are also used, although typically the powdered dyes are solubilized in an oil solvent than is blended with the paraffin wax. In the context of this invention, liquid oil dyes are defined to include solubilized powdered dyes. In some cases, powdered dyes and/or pigments are blended directly with the paraffin wax. To be compatible with the paraffin waxes, the liquid dyes are generally oil-based. However, there is a limit to the amount of essential oil and/or oil-based dye that may be added to a paraffin wax candle before separation of the oil occurs at room temperature. Oil separation is undesirable because it removes the oil from the candle making it unavailable for scenting the air, mars the appearance of the candle and makes it unattractive for sale—particularly if the oil is carrying dye, and creates a nuisance that must be cleaned up. Typically, the oil "bleeds" or rises to the top (or surface) of the candle or object and pools at the top in a relatively short amount of time.

The oil separation problem is particularly aggravated in mottled candles. Mottling of waxes has been used to produce a variety of different textures and appearances to candles. Mottling within the context of this invention is the formation of small, generally white inclusions in the paraffin wax that contrast with a background color. The inclusions are relatively small, usually less than 1 mm, and are often described as "flowers", "snowflakes", "starbursts", and "snow spotting". Mottling is not to be confused with fractures and cracks that appear from quench cooling of a candle.

To achieve the mottling appearance on the candle surface, some form of liquid phase should be present, and generally the fragrance oil and/or oil dye is used, although soft wax components that are liquid at room temperature or mineral oil may be used. Relatively slow cooling of the candle is also generally necessary for mottling to occur on the candle surface. For instance, if paraffin wax is melted at 75° C. (167° F.) and mixed with 5 wt % commercially available fragrance and/or dye and then slowly cooled to room temperature, mottling will occur. One non-limiting explanation for the mottling phenomenon is as follows. Wax crystals begin to nucleate at about 60° C., leading to the production of larger, needle-like crystals that grow in breadth and length as crystallization progresses. At the solid-solid transition point of about 40° C., the point at which solid wax re-crystallizes, contractions in the crystalline boundaries are thought to cause microcracks and bubbles. A vapor phase, which may be air, propagates through the wax during this solid transition displacing the liquid oils in the crystalline interstices. Mottling occurs as larger gaps occur between crystals. Light refraction at the crystal surfaces gives a white snowflake pattern characteristic of mottling. Increasing the liquid phase reduces the cohesive forces between crystals thereby permitting the creation of more voids causing increased mottling.

To obtain a highly fragranced candle, a deeply colored candle (color intensity can be manipulated independent of concentration and can be a powder additive) and/or a mottled candle, it is necessary to use liquid additives, particularly liquid oil additives (oil additives liquid at ambient temperature). Paraffin with a high oil content will mottle but this is not a common commercial practice. However, these same oils tend to undesirably separate from the paraffin wax at room temperature. Thus, it would be desirable if some technique or additive could be provided that would prevent or inhibit the separation of liquid oil additives from paraffin waxes and yet would encourage or not inhibit a mottling effect.

SUMMARY OF THE INVENTION

An object of the invention is to provide a method for forming paraffin objects, such as candles, which contain oils, but where the object has a reduced tendency for the oil to separate from the paraffin wax.

Another object of the invention is to provide a candle or other paraffin object containing an oil that is normally liquid at room temperature (such as to provide a fragrance and appearance effect, e.g. color and/or mottling), where the oil is inhibited from separating from the paraffin wax when the object is stored at room temperature. The invention is particularly addressed to paraffin objects where a fragrance and an appearance effect are coupled in the same object.

In carrying out these and other objects of the invention, there is provided, in one form, a method of making a paraffin object by combining a paraffin wax with at least one oil that is liquid at ambient temperature, and an amount of an additive effective to inhibit separation of the oil from the paraffin wax, where the additive comprises a branched poly(alpha olefin). The invention also involves objects made by this method. It will be appreciated that while the inventive method may be used to make candles, it may also be used to make other paraffin objects containing an oil where it is desired to prevent separation of the oil from the paraffin wax. The paraffin objects have a mottled appearance.

DETAILED DESCRIPTION OF THE INVENTION

In the present method, it has been discovered that the use of a branched poly(alpha olefin) additive together with paraffin wax and a liquid oil helps prevent, retard, mitigate, reduce, control, delay or inhibit the separation, removal, division, isolation, severance, or partition of the oil from the paraffin wax at room temperature. As noted, when oils are included with paraffin waxes, they will often separate from the wax when the object is held at room temperature, even for relatively short periods of time (less than twenty-four hours).

The term "inhibiting" is used herein in a broad and general sense to mean any improvement in preventing, controlling, delaying, reducing or mitigating the separation, partitioning and/or removal of liquid components, especially liquid oil components in any manner, including, but not limited to, by dissolution, by breaking up, other mechanisms, or any combination thereof. Although the term "inhibiting" is not intended to be restricted to the complete prevention of liquid separation, it may include the possibility that separation of any liquid is entirely prevented.

The nature of the paraffin wax is not critical to the practice of this invention and may be any of the numerous commercial paraffin waxes used. While the invention has only been exemplified with relatively high molecular weight petroleum waxes, it is expected that the method of this invention would find utility in inhibiting the separation of oils from objects made with other waxes, including, but not necessarily limited to, beeswax, bayberry wax, candelilla wax, and the like. In one non-limiting embodiment of the invention, the paraffin wax has from 18 to 56 and greater carbon atoms, preferably from 22 to 46 carbon atoms. In another non-limiting embodiment of the invention, the paraffin wax has at least 50 wt % of the alkanes present as normal alkanes and where the wax has a melt point of 52° C. or greater.

With respect to the oil, the invention is expected to be effective with respect to most, if not all oils typically added to waxes, where the oil is liquid at ambient temperatures. These liquid oils include, but are not necessarily limited to, essential oils, fragrances, oil-based dyes, mineral oils, liquid oils used to provide other benefits in properties or appearance such as mottling, and the like. One definition of essential oil is a volatile oil derived from the leaves, stem, flower, or twigs of plants, and usually carrying the odor or flavor of the plant. Of course, more than one liquid oil may be used simultaneously, and often are in the case of candles where a fragrance and a dye are employed together. In one non-limiting embodiment of the invention, the liquid oils are used in a total amount, based on the total weight of the object, in proportions ranging from about 0 to about 40 wt %, preferably from about 0.1 to about 30 wt %, more preferably from about 0.5 to about 20 wt %, and most preferably from about 0.5 to about 11 wt %. In one non-limiting embodiment of the invention, the paraffin objects include pigments and powdered dyes added to the paraffin wax without being first mixed with an oil.

The branched poly(alpha olefin) additive of this invention may be any branched poly(alpha olefin) having a molecular weight from about 100 to about 130,000, preferably from about 150 to about 100,000, in one non-limiting embodiment from about 200 to about 70,000, and most preferably from about 200 to about 40,000. In the scope of this invention, the term poly(alpha olefin) is defined to include oligomers of alpha olefins. The alpha-olefins used to make the branched poly(alpha olefin) may have at least 14 carbon atoms. The alpha-olefins may preferably have between 14 and 30, and even up to about 44 and most preferably have primarily from 20 to 24 carbon atoms. In a particularly preferred non-limiting embodiment of the invention, the alpha olefin has greater than 14 carbon atoms, and in another embodiment has greater than 14 and 30 or less carbon atoms. In another non-limiting embodiment of the invention, the poly(alpha olefin) has a softening point between about 80 and about 175° F. (about 26 and about 79° C.), preferably between about 90 and about 165° F. (about 32 and about 74° C.). Further, with respect to viscosity, the viscosity of the poly(alpha olefin) may be between about 30 cPs and about 1800 cPs at 210° F. (99° C.), preferably between about 80 and 220 cPs. The method of polymerizing the alpha-olefins should be any method that gives branching. The poly(alpha-olefin) of this invention should have at least one branch, in one non-limiting embodiment of the invention. Typically, an amorphous wax will exhibit a superior ability to stabilize or hold oil relative to a highly crystalline wax. Manipulating the crystallinity of a wax may be achieved by wax selection or modification through incorporating highly branched polymer additives such as VYBAR polymers. Methods of polymerizing the alpha-olefins may include, but are not necessarily limited to, free-radical polymerization (using conventional free radical methods such as thermal decomposition, photoinitiation, electrochemical initiation, etc. and using chemical free-radical initiators such as azo or diazo compounds, peroxides or hydroperoxides, etc.), coordination polymerization, etc. A particularly preferred branched poly(alpha olefin) additive that falls within the definition given above is VYBAR® 343 polymer available from Baker Hughes Incorporated (Baker Petrolite Polymers Division).

It will be appreciated that it is difficult, if not impossible, to specify with accuracy in advance the proportion of additive to be used in a particular paraffin wax formulation to inhibit oil separation. The best way to determine this proportion is by experimentation. The proportion of poly (alpha olefin) additive in a particular paraffin wax formulation will depend upon a number of complex, interrelated factors including, but not necessarily limited to, the nature of the paraffin wax, the proportion and nature of the liquid oil additives, the nature of the poly(alpha olefin) additive, the processing of the paraffin object including, but not necessarily limited to, the initial melt temperature and the rate of cooling, among other factors. Nevertheless, in an effort to give some indication of typical poly(alpha olefin) additive proportions, in non-limiting embodiments the amount of branched poly(alpha olefin) in the object may range from about 0.1 wt % to about 90.0 wt %, based on the total object weight, preferably from about 0.25 wt % to about 20.0 wt %. It will be appreciated that a typical temperature for combining the components of paraffin objects within the method of this invention may range between about 130 and about 212° F. (between about 54 and 100° C.).

It will further be appreciated that in one non-limiting embodiment of the invention, it is not necessary that the separation of the oil from the paraffin wax is prevented, stopped or totally inhibited or controlled. The invention is considered to be successful and effective if separation is inhibited as compared with an otherwise identical paraffin object where the only difference is the absence of the branched poly(alpha olefin).

The contacting of the branched poly(alpha olefin) additive with the paraffin wax and liquid additive may be achieved by a number of ways or techniques, including, but not necessarily limited to, mixing, blending with mechanical mixing equipment or devices, stationary mixing setup or equipment, magnetic mixing or other suitable methods, other equipment and means known to one skilled in the art and combinations thereof to provide adequate contact and/or dispersion of the composition in the mixture. The various components of the composition may be mixed prior to or during contact, or both.

The invention is further illustrated with respect to the following Examples that are included only to more fully describe the invention without necessarily limiting its scope.

EXAMPLES 1–8

Examples 1–8 are reported in Table I below. The base wax used in all Examples was PARAVAN 142. PARAVAN paraffin waxes are available from EXXON Corporation. All wax formulations included PYLA-WAX Dark Red available from PYLAM Products Company. The fragrance was Vanilla 2013 available from French Color and Chemical. All numerical values are weights in grams.

For the following tables the following scoring system was applied to differentiate the performance of each blend.

A 1 through 6 scale was used to describe mottling characteristics and a 1 through 5 scale to describe oil bleed. The higher values are most desirable. The scores are assigned based on visual observation relative to a control sample that has a composition of paraffin wax, fragrance, and dye.

| | | |
|---|---|---|
| 1 | Mottling | 0% visual surface mottling |
| | Oil Bleed | Visible oil bleed equal to (100%) that of the group control |
| 2 | Mottling | Greater than 0% but less than or equal to 25% visible surface mottling |
| | Oil Bleed | Less than 100% but greater than or equal to 75% visible oil bleed |
| 3 | Mottling | Greater than 25% but less than or equal to 75% visible surface mottling |
| | Oil Bleed | Less than 75% but greater than or equal to 25% visible oil bleed |
| 4 | Mottling | Greater than 75% but less than 100% visible surface mottling |
| | Oil Bleed | Less than 25% but greater than 0% visible surface oil bleed |
| 5 | Mottling | 100% surface mottling relative to that of the group control |
| | Oil Bleed | No visible oil bleed (0%) |
| 6 | Mottling | Visible mottling exceeding that of the group control |

TABLE I

| Ex. | Base wax | Additive | Additive wt | Fragrance | Mottling Score | Oil Bleed Score |
|---|---|---|---|---|---|---|
| 1 | 95.0 | None | 0.0 | 5.0 | 5 | 1 |
| 2 | 93.0 | Sample A | 2.0 | 5.0 | 1 | 4 |
| 3 | 94.9 | Sample A | 0.1 | 5.0 | 4 | 5 |
| 4 | 93.0 | Sample B | 2.0 | 5.0 | 2 | 3 |
| 5 | 93.0 | VYBAR 343 | 2.0 | 5.0 | 5 | 5 |
| 6 | 93.0 | Sample C | 2.0 | 5.0 | 2 | 2 |
| 7 | 93.0 | Sample D | 2.0 | 5.0 | 2 | 3 |
| 8 | 95.0 | VYBAR 260 | .02 | 5.0 | 3 | 5 |
| 9 | 94.9 | VYBAR 260 | .05 | 5.0 | 3 | 5 |
| 10 | 94.9 | VYBAR 260 | 0.1 | 5.0 | 3 | 5 |
| 11 | 94.8 | VYBAR 260 | 0.2 | 5.0 | 2 | 5 |
| 12 | 94.9 | VYBAR 103 | 0.02 | 5.0 | 2 | 5 |
| 13 | 94.9 | VYBAR 103 | 0.05 | 5.0 | 2 | 5 |
| 14 | 94.8 | VYBAR 103 | 0.2 | 5.0 | 1 | 5 |
| 15 | 93.0 | VYBAR 103 | 2.0 | 5.0 | 1 | 5 |

| | |
|---|---|
| Sample A | A polymer additive with a higher softening point (58° C.) than VYBAR 343 polymer (37.5° C.) |
| Sample B | A polymer additive with a higher softening point (70.5° C.) than VYBAR 343 polymer |
| VYBAR 343 polymer | A polymer additive with a typical softening point of 40.5° C. and typical viscosity of 135 cPs at 99° C. |
| Sample C | A polymer additive with a higher viscosity (250 cPs @ 99° C.) than VYBAR 343 polymer (113 cPs @ 99° C.) |
| Sample D | A polymer additive with a softening point less than 25° C. |

-continued

| | |
|---|---|
| VYBAR ® 260 polymer | A common wax additive with a typical softening point of 54° C. |
| VYBAR ® 103 polymer | A common wax additive with a typical softening point of 74° C. |

The VYBAR 343 of Example 5 appeared to eliminate oil bleed while not inhibiting mottling. In one non-limiting embodiment of the invention, it may be preferred to use the additive in higher melt point paraffins, that is, those with a melt point of about 58° C. or greater.

EXAMPLES 16–23

Examples 16–23 are reported in Table II below. The base wax was PARAVAN 131 paraffin wax. All wax formulations included a trace amount of dye added to the paraffin wax prior to blending. The fragrance was Vanilla 2013 available from French Color and Chemical. All numerical values are weights in grams.

TABLE II

| Ex. | Base wax | VYBAR 343 | Fragrance | Mottling Score | Oil Bleed Score |
|---|---|---|---|---|---|
| 16 | 94 | 1 | 5 | 5 | 1 |
| 17 | 92 | 3 | 5 | 5 | 2 |
| 18 | 90 | 5 | 5 | 5 | 5 |
| 19 | 92 | 1 | 7 | 5 | 1 |
| 20 | 90 | 3 | 7 | 6 | 1 |
| 21 | 88 | 5 | 7 | 6 | 4 |
| 22 | 95 | 0 | 5 | 5 | 1 |
| 23 | 93 | 0 | 7 | 5 | 1 |

Remarks for all Examples 16–23: Visible oil bleed to the surface of the wax was visibly eliminated or far superior relative to a non-treated wax and fragrance blend in blends 18 and 21. The implication of Tables I and II is such that addition rates of VYBAR 343 required to achieve a mottled candle with reduced or eliminated oil bleed may increase as the molecular weight of the paraffin decreases.

EXAMPLES 24–30

Examples 24–30 are reported in Table III below. The base wax was PARAVAN 142 paraffin wax available from EXXON Corporation. All wax formulations included a trace amount of dye added to the paraffin wax prior to blending. The fragrance was Vanilla 2013 available from French Color and Chemical. All numerical values are weights in grams. Oil bleed was determined by observation. All candles were observed for oil bleed after at least 24 hours at ambient temperature (75–85° F.).

TABLE III

| Ex. | Base wax | VYBAR 343 | Fragrance | Mottling Score | Oil Bleed Score |
|---|---|---|---|---|---|
| 24 | 94 | 1 | 5 | 5 | 4 & 5* |
| 25 | 92 | 3 | 5 | 5 | 4 |
| 26 | 90 | 5 | 5 | 5 | 4 & 5* |
| 27 | 92 | 1 | 7 | 5 | 4 |
| 28 | 90 | 3 | 7 | 5 | 5 |
| 29 | 88 | 5 | 7 | 6 | 5 |
| 30 | 95 | 0 | 5 | 5 | 1 |

*Dual samples

EXAMPLES 31–34

Examples 31–34 are reported in Table IV below. The base wax was a paraffin wax with a reported normal paraffin content of 67%. All wax formulations included a trace amount (less than 0.1% (wt.) to accentuate mottling—for observation purposes) of dye added to the paraffin wax prior to blending. The dye was PYLA-WAX Dark Red available from PYLAM Products Company The fragrance was Vanilla 2013 available from French Color and Chemical. UNILIN 350 is a linear polymeric alcohol of molecular weight about 350 available from Baker Petrolite. All numerical values are weights in grams. A successful blend will allow mottling, but not oil bleed

TABLE IV

| Ex | VYBAR 343 | UNILIN 350 | Fragrance | Paraffin wax | Comments |
|---|---|---|---|---|---|
| 31 | 1.0 | — | 5.0 | 94.0 | No mottling |
| 32 | 3.0 | — | 5.0 | 92.0 | No mottling |
| 33 | — | 0.5 | 5.0 | 94.5 | No mottling |
| 34 | — | — | 7.0 | 93.0 | No mottling, no bleed at 80° F. in 6 hrs |

The candles made in Examples 31–34 were container-mottled candles. Container candles are a type of candle produced and used in the same vessel it is formed in; typically this candle type contains the highest oil loads of commercial candle product offerings.

It was observed that paraffin with a reported normal paraffin content of 67% was resistant to the formation of mottling with or without the addition of VYBAR 343 polymer. VYBAR 343 polymer at typical addition rates does not appear to generate mottling in paraffin wax that does not typically mottle. Other molecules present in this paraffin may include isoparaffins, cycloparaffins and arylparaffins.

EXAMPLES 35–41

Examples 35–41 are reported in Table V below. The base wax A is Scentis SCW 251 paraffin wax available from Shell Canada Limited. Base wax B is SP-3040 paraffin wax available from Nippon Siero. The base wax C is Callista 142 wax available from Shell. All wax formulations included a trace amount of dye added to the paraffin wax prior to blending. The fragrance was Mulberry 2050 available from French Color and Chemical. All numerical values are weights in grams.

TABLE V

| Ex. | VYBAR 343 | Fragrance | Wax A | Wax B | Wax C | Mottling Score | Oil Bleed Score |
|---|---|---|---|---|---|---|---|
| 35 | 1 | 5 | 94 | | | 5 | 2 |
| 36 | 4 | 5 | 91 | | | 5 | 4 |
| 37 | | 5 | 95 | | | 5 | 1 |
| 38 | 1 | 5 | | 94 | | 5 | 4 |
| 39 | | 5 | | 95 | | 5 | 1 |
| 40 | 1 | 5 | | | 94 | 6 | 5 |
| 41 | | 5 | | | 95 | 5 | 1 |

EXAMPLES 42–51

Examples 42–51 are reported in Table VI below. The base wax was PARAVAN 142 paraffin wax. All wax formulations included a trace amount of dye added to the paraffin wax prior to blending. The fragrance was Mulberry 2050 available from French Color and Chemical. All numerical values are weights in grams.

TABLE VI

| Ex. | Paraffin | VYBAR 343 | Dye | Fragrance | Mottling Score | Oil Bleed Score |
|---|---|---|---|---|---|---|
| 42 | 98 | 1 | <.01% | 1 | 2 | 5 |
| 43 | 96 | 1 | <.01% | 3 | 3 | 4 |
| 44 | 94 | 1 | <.01% | 5 | 6 | 4 |
| 45 | 92 | 1 | <.01% | 7 | 6 | 4 |
| 46 | 90 | 1 | <.01% | 9 | 6 | 4 |
| 47 | 88 | 1 | <.01% | 11 | 6 | 4 |
| 48 | 86 | 1 | <.01% | 13 | 6 | 1 |
| 49 | 84 | 1 | <.01% | 13 | 6 | 1 |

TABLE VI-continued

| Ex. | Paraffin | VYBAR 343 | Dye | Fragrance | Mottling Score | Oil Bleed Score |
|---|---|---|---|---|---|---|
| 50 | 82 | 5 | <.01% | 13 | 6 | 1 |
| 51 | 95 | 0 | <.01% | 5 | 5 | 1 |

EXAMPLES 52–66

Examples 52–66 are reported in Table VII below. The base wax was PARAVAN 142 paraffin wax. All wax formulations included a trace amount of dye added to the paraffin wax prior to blending. The fragrance was Mulberry 2050 available from French Color and Chemical. All numerical values are weights in grams.

TABLE VII

| Ex. | Paraffin | Fragrance | A | B | C | D | E | F | G | H | I | J | K | L | M | N | Mottling Score | Oil Bleed Score |
|---|---|---|---|---|---|---|---|---|---|---|---|---|---|---|---|---|---|---|
| 52 | 96 | 4 | | | | | | | | | | | | | | | 5 | 1 |
| 53 | 95 | 4 | 1 | | | | | | | | | | | | | | 6 | 2 |
| 54 | 95 | 4 | | 1 | | | | | | | | | | | | | 6 | 3 |
| 55 | 95 | 4 | | | 1 | | | | | | | | | | | | 6 | 5 |
| 56 | 95 | 4 | | | | 1 | | | | | | | | | | | 6 | 5 |
| 57 | 95 | 4 | | | | | 1 | | | | | | | | | | 5 | 5 |
| 58 | 95 | 4 | | | | | | 1 | | | | | | | | | 6 | 5 |
| 59 | 95 | 4 | | | | | | | 1 | | | | | | | | 6 | 5 |
| 60 | 95 | 4 | | | | | | | | 1 | | | | | | | 6 | 5 |
| 61 | 95 | 4 | | | | | | | | | 1 | | | | | | 4 | 5 |
| 62 | 95 | 4 | | | | | | | | | | 1 | | | | | 3 | 5 |
| 63 | 95 | 4 | | | | | | | | | | | 1 | | | | 3 | 3 |
| 64 | 95 | 4 | | | | | | | | | | | | 1 | | | 4 | 3 |
| 65 | 95 | 4 | | | | | | | | | | | | | 1 | | 4 | 4 |
| 66 | 95 | 4 | | | | | | | | | | | | | | 1 | 3 | 3 |

Example A A sample of the VYBAR 343 process with a viscosity of approximately 30 cPs at 99° C.

Example B A sample of the VYBAR 343 process with a viscosity of approximately 60 cPs at 99° C.

Example C A sample of the VYBAR 343 process with a viscosity of approximately 80 cPs at 99° C.

Example D A sample of the VYBAR 343 process with a viscosity of approximately 85 cPs at 99° C.

Example E A sample of the VYBAR 343 process with a viscosity of approximately 125 cPs at 99° C.

Example F A sample of the VYBAR 343 process with a viscosity of approximately 135 cPs at 99° C.

Example G A sample of the VYBAR 343 process with a viscosity of approximately 150 cPs at 99° C.

Example H A sample of the VYBAR 343 process with a viscosity of approximately 190 cPs at 99° C.

Example I A sample of the VYBAR 343 process with a viscosity of approximately 220 cPs at 99° C.

Example J A sample of the VYBAR 343 process with a viscosity of approximately 300 cPs at 99° C.

Example K A sample of the VYBAR 343 process with a viscosity of approximately 375 cPs at 99° C.

Example L A sample of the VYBAR 343 process with a viscosity of approximately 490 cPs at 99° C.

Example M A sample of the VYBAR 343 process with a viscosity of approximately 1025 cPs at 99° C.

Example N A sample of the VYBAR 343 process with a viscosity of approximately 1775 cPs at 99° C.

In general, it has been demonstrated that a branched poly(alpha olefin) additive can be used in a candle application, particularly a mottled candle application using common commercial fragrances that yielded a final product that has none or significantly reduced oil migration to the surface of the wax. As noted, fragrance loads of candles have been typically limited due to oil bleed. Typically, as the addition rate of the branched poly(alpha olefin) additive increased, so did the degree of mottling. It was also possible to cool the molten paraffin wax formulation to temperatures of 55° F. (13° C.) and still obtain a dry, mottled candle. Although the observation timing was not optimized for these Examples, the typical observation period was approximately 2 hours+/−15 minutes. Typically, shock cooling reduces or eliminates the appearance of mottling.

Many modifications may be made in the composition and implementation of this invention without departing from the spirit and scope thereof that are defined only in the appended claims. For example, exact combinations of liquid oils and branched poly(alpha olefin) may be different from those exemplified here. Further, different poly(alpha olefins) from those discussed and exemplified are also expected to be useful in the inventive method and products. It will be appreciated that the inventive method may be used to make other paraffin objects containing an oil where it is desired to prevent separation of the oil from the paraffin wax, for example in surfboard waxes, waxes used by in-line skaters and skateboarders on edges of structures used in tricks, and other paraffin waxes.

I claim:

1. A paraffin object comprising:

a paraffin wax;

at least one oil that is liquid at ambient temperature; and an amount of an additive effective to inhibit separation of the oil from the paraffin wax, where the additive comprises a branched poly(alpha olefin), where the paraffin object has a mottled appearance.

2. The paraffin object of claim 1 where the paraffin wax further comprises a petroleum wax comprising alkanes where at least 50 wt % of the alkanes are normal alkanes and having a melt point of 52° C. or greater.

3. The paraffin object of claim 1 where the oil is selected from the group consisting of a fragrant essential oil, a synthetic fragrance, a liquid oil dye, and combinations thereof.

4. The paraffin object of claim 1 where the branched poly(alpha olefin) has a molecular weight of from about 200 to about 70,000.

5. The paraffin object in claim 1 where the branched poly(alpha olefin) comprises polymerizing an alpha olefin having from 20 to 24 carbon atoms.

6. The paraffin object in claim 1 where the branched poly(alpha olefin) has a viscosity from about 30 cPs to about 1775 cPs at 210° F.

7. The paraffin object of claim 1 where the amount of oil in the object ranges from about 0.1 to about 40 wt %, and where the amount of branched poly(alpha olefin) in the object ranges from about 0.1 to about 90.0 wt %, based on the total object weight.

8. A paraffin object comprising:

a paraffin wax comprising a petroleum wax comprising alkanes where at least 50 wt % of the alkanes are normal alkanes and having a melt point of 52° C. or greater;

at least one oil that is liquid at ambient temperature; and an amount of an additive effective to inhibit separation of the oil from the paraffin wax, where the additive comprises a branched poly(alpha olefin) formed by polymerizing an alpha olefin having greater than 14 carbon atoms, where the paraffin object has a mottled appearance.

9. The paraffin object of claim 8 where the oil is selected from the group consisting of a fragrant essential oil, a liquid oil dye, and combinations thereof.

10. The paraffin object of claim 8 where the amount of oil in the object ranges from about 0.1 to about 40 wt %, and where the amount of branched poly(alpha olefin) in the object ranges from about 0.1 to about 90.0 wt %, based on the total object weight.

11. A method of making a paraffin object comprising combining:

a paraffin wax;

at least one oil that is liquid at ambient temperature; and an amount of an additive effective to inhibit separation of the oil from the paraffin wax, where the additive comprises a branched poly(alpha olefin)

where the paraffin object has a mottled appearance.

12. The method of claim 11 where in the combining the paraffin wax further comprises a petroleum wax comprising alkanes where at least 50 wt % of the alkanes are normal alkanes and having a melt point of 52° C. or greater.

13. The method of claim 11 where in the combining the oil is selected from the group consisting of a fragrant essential oil, a liquid oil dye, and combinations thereof.

14. The method of claim 11 where in the combining the branched poly(alpha olefin) has a molecular weight of from about 200 to about 70,000.

15. The method of claim 11 where in the combining, the branched poly(alpha olefin) comprises polymerizing an alpha olefin having from 20 to 24 carbon atoms.

16. The method of claim 11 where in the combining the branched poly(alpha olefin) has a viscosity from about 30 cPs to about 1775 cPs at 210° F.

17. The method of claim 11 where in the combining the amount of oil in the object ranges from about 0.1 to about 40.0 wt %, and where the amount of branched poly(alpha olefin) in the object ranges from about 0.1 to about 90.0 wt %, based on the total object weight.

18. The method of claim 11 where the combining is conducted at a temperature between about 130 and about 212° F. (about 54 and about 100° C.).

19. A method of making a paraffin object comprising combining:

a paraffin wax comprising a petroleum wax comprising alkanes where at least 50 wt % of the alkanes are normal alkanes and having a melt point of 52° C. or greater;

at least one oil that is liquid at ambient temperature; and an amount of an additive effective to inhibit separation of the oil from the paraffin wax, where the additive comprises a branched poly(alpha olefin) formed by polymerizing an alpha olefin having from greater than 14 carbon atoms.

where the paraffin object has a mottled appearance.

20. The method of claim 19 where in the combining the oil is selected from the group consisting of a fragrant essential oil, a liquid oil dye, and combinations thereof.

21. The method of claim 19 where in the combining the amount of oil in the object ranges from about 0.1 to about 40.0 wt %, and where the amount of branched poly(alpha olefin) in the object ranges from about 0.1 to about 90.0 wt %, based on the total object weight.

22. The method of claim 19 where the combining is conducted at a temperature between about 130 and about 212° F. (about 54 and about 100° C.).

* * * * *

UNITED STATES PATENT AND TRADEMARK OFFICE

CERTIFICATE OF CORRECTION

PATENT NO. : 6,776,808 B2
DATED : August 17, 2004
INVENTOR(S) : Rodney Jack Foster It is certified that error appears in the above-identified patent and that said Letters Patent is hereby corrected as shown below:

Column 6,
Line 7, please replace "PARAVAN" with -- PARVAN --

Column 7,
Lines 19 and 59, please replace "PARAVAN" with -- PARVAN --

Column 9,
Line 51, please replace "PARAVAN" with -- PARVAN --

Column 10,
Line 11, please replace "PARAVAN" with -- PARVAN --

Column 12,
Line 61, please insert the words -- ,and is -- after ")" and before "formed"
Line 62, pleae remove "." after "atoms"

Signed and Sealed this

Twenty-fourth Day of May, 2005

JON W. DUDAS
*Director of the United States Patent and Trademark Office*